US010710691B2

(12) United States Patent
Amerling et al.

(10) Patent No.: US 10,710,691 B2
(45) **Date of Patent: *Jul. 14, 2020**

(54) MARINE DRIVES AND ARRANGEMENTS FOR RIGGING MARINE DRIVES

(71) Applicant: Brunswick Corporation, Mettawa, IL (US)

(72) Inventors: Steven J. Amerling, Fond du Lac, WI (US); Brad J. VanRuiswyk, Waupun, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/363,525

(22) Filed: Mar. 25, 2019

(65) Prior Publication Data

US 2019/0217935 A1 Jul. 18, 2019

Related U.S. Application Data

(63) Continuation of application No. 15/869,986, filed on Jan. 12, 2018, now Pat. No. 10,286,989.

(51) Int. Cl.
*B63H 20/32* (2006.01)
*B63H 21/36* (2006.01)

(52) U.S. Cl.
CPC ..... *B63H 20/32* (2013.01)

(58) Field of Classification Search
CPC .... B63H 20/00; B63H 20/32; B63H 2020/00; B63H 2020/008; B63H 2020/32
USPC ..... 440/76, 77
See application file for complete search history.

(56) References Cited

U.S. PATENT DOCUMENTS

| | | | |
|---|---|---|---|
| 3,950,059 | A | 4/1976 | Anhalt et al. |
| 4,933,809 | A | 6/1990 | Boede et al. |
| 4,969,847 | A | 11/1990 | Curtis et al. |
| 5,007,858 | A | 4/1991 | Daly et al. |
| 5,105,334 | A | 4/1992 | Holinka |
| 5,637,021 | A | 6/1997 | Watanabe |
| 6,183,322 | B1 | 2/2001 | Takahashi |
| 6,257,940 | B1 | 7/2001 | Dunham et al. |
| 6,273,771 | B1 | 8/2001 | Buckley et al. |
| 6,364,724 | B1 | 4/2002 | Nozawa et al. |
| 6,960,108 | B1 | 11/2005 | Jaszewski et al. |
| 7,104,856 | B1 | 9/2006 | Krupp et al. |
| 7,144,283 | B2 | 12/2006 | Kawase |

(Continued)

*Primary Examiner* — Daniel V Venne
(74) *Attorney, Agent, or Firm* — Andrus Intellectual Property Law, LLP

(57) ABSTRACT

A marine drive includes an engine; a cowl having first and second cowl portions. The first cowl portion is movable with respect to the second cowl portion into an open position in which the engine is manually accessible and a closed position in which the engine is enclosed; and a rigging port in the second cowl portion. The rigging port provides a passageway for rigging connectors extending from the engine to a component located remotely from the engine. A rigging opening provides manual access to the rigging connectors and the engine, including when the first cowl portion is in the closed position. A removable access door covers the rigging opening and prevents manual access to the engine and rigging connectors via the rigging opening. The removable access door is fastened to the second cowl portion by a removable fastener that is hidden from view.

20 Claims, 7 Drawing Sheets

(56) References Cited

U.S. PATENT DOCUMENTS

| | | | | |
|---|---|---|---|---|
| 7,704,109 | B2 | 4/2010 | Arai et al. | |
| 7,883,385 | B2 | 2/2011 | Sakamoto | |
| 8,858,280 | B1 | 10/2014 | Wiegele et al. | |
| 9,580,943 | B1 * | 2/2017 | Amerling | E05C 3/145 |
| 9,580,947 | B1 * | 2/2017 | Amerling | E05C 19/12 |
| 10,017,136 | B1 * | 7/2018 | Waisanen | B63H 20/02 |

* cited by examiner

MARINE DRIVES AND ARRANGEMENTS FOR RIGGING MARINE DRIVES

CROSS-REFERENCE TO RELATED APPLICATION

The present application is a continuation of U.S. application Ser. No. 15/869,986, filed Jan. 12, 2018, which is hereby incorporated by reference in its entirety.

FIELD

The present disclosure relates to marine drives and more particularly to arrangements for rigging marine drives.

BACKGROUND

The following US patents are incorporated herein by reference:

U.S. Pat. No. 9,580,947 discloses a cowl for an outboard engine having an internal combustion engine. The cowl comprises a first cowl portion; a second cowl portion that mates with the first cowl portion to enclose the internal combustion engine; a service door on the second cowl portion, wherein the service door is position-able in an open position and in a closed position; and a carrying handle on the second cowl portion. The carrying handle is accessible when the service door is in the open position and inaccessible when the service door is in the closed position. A plurality of latches is spaced apart around the perimeter. The latches latch the second cowl portion to the first cowl portion. An actuator assembly actuates each of the plurality of latches. The actuator assembly can be actuated by movement of the carrying handle.

U.S. Pat. No. 9,580,943 discloses a latching device for a cowl on an outboard marine engine, the cowl having first and second cowl portions that are separated from each other in an open cowl position and that are latched together by the latching device in a closed cowl position. A retainer is adapted to be fixed to the first cowl portion and a latch is adapted to be fixed to the second cowl portion. The latch is movable into and between a latched position in which the latch is latched to the retainer and an unlatched position in which the latch is unlatched from the retainer. The latch comprises an engagement member, a bell crank, and a spring that is coupled to the engagement member and the bell crank. Movement of the bell crank with respect to the engagement member generates an over-center force on the engagement member that facilitates latching and unlatching of the engagement member and the retainer.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

A marine drive includes an engine; a cowl having first and second cowl portions, wherein the first cowl portion is movable with respect to the second cowl portion into an open position in which the engine is manually accessible and a closed position in which the engine is enclosed by the cowl; and a rigging port in the second cowl portion. The rigging port provides a passageway for rigging connectors that extend from the engine to a component located remotely from the engine. A rigging opening in the second cowl portion provides manual access to the rigging connectors and the engine, including when the first cowl portion is in the closed position. A removable access door covers the rigging opening and prevents manual access to the engine and the rigging connectors via the rigging opening. The removable access door is fastened to the second cowl portion by a removable fastener that is hidden from view.

DETAILED DESCRIPTION OF THE DRAWINGS

Figure 1:
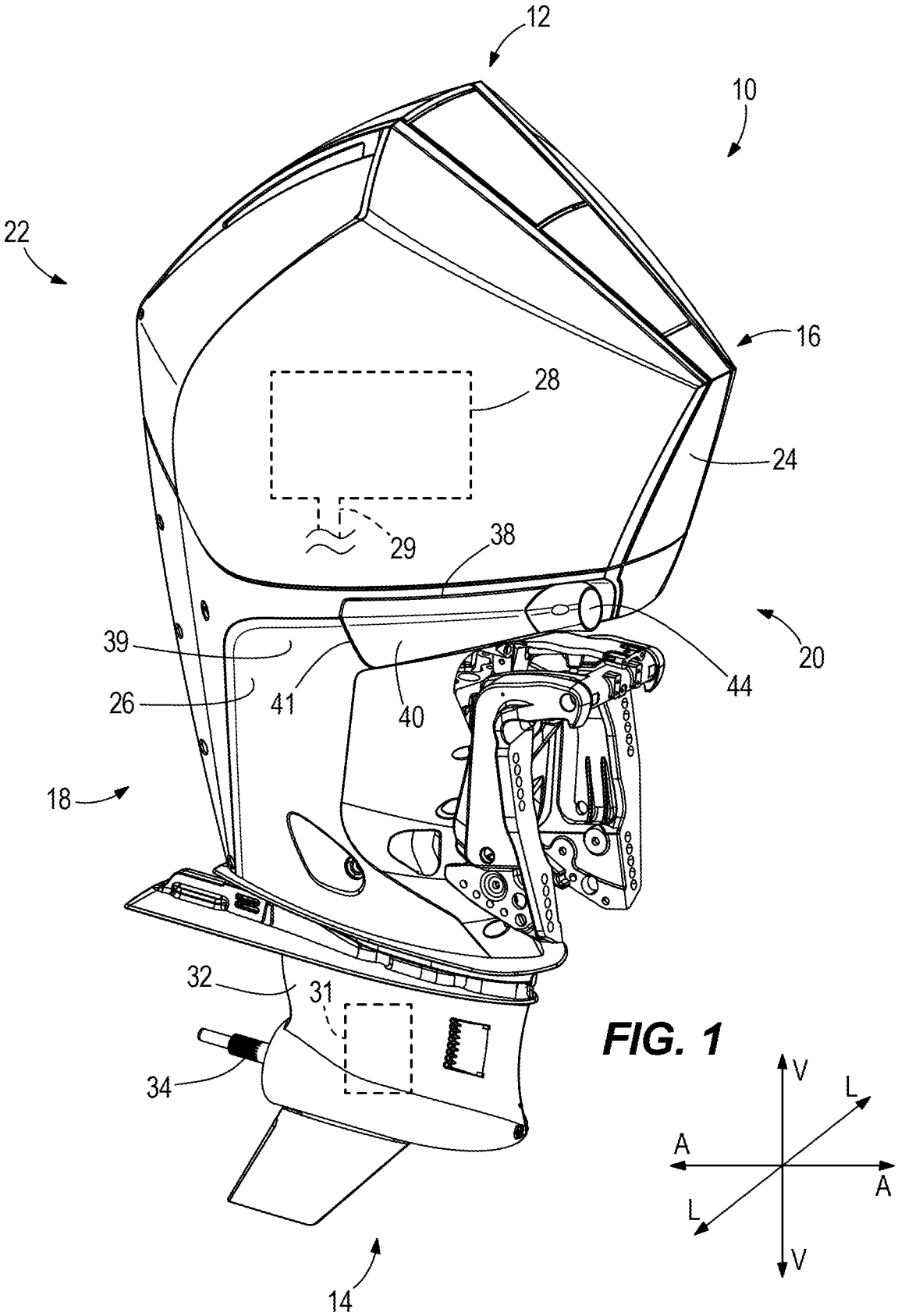
FIG. 1 is a perspective view of an outboard motor for propelling a marine vessel in water.

FIG. 1 depicts a marine drive for propelling a marine vessel in water. In the illustrated example, the marine drive is an outboard motor 10; however the concepts of the present disclosure are also applicable to any other type of marine drive that requires rigging (i.e., operably connecting) to remote components, such as components on the marine vessel to which the marine drive is attached, including for example the helm of the marine vessel, the trim system for the marine drive, the fuel system for the marine drive, the steering system for the marine drive, and/or the like. In the illustrated example, the outboard motor 10 extends from top 12 to bottom 14 in a vertical direction V, from portside 16 to starboard side 18 in a lateral direction L that is perpendicular to the vertical direction V, and from forward side 20 to aftward side 22 in an axial direction A that is perpendicular to the vertical direction V and perpendicular to the lateral direction L.

In the illustrated example, the outboard motor 10 has an upper cowl portion 24 and a lower cowl portion 26. The upper cowl portion 24 is movable, including but not limited to pivotable with respect to the lower cowl portion 26 and/or removable from the lower cowl portion 26, as is conventional, to provide manual access to the interior of the outboard motor 10. The upper cowl portion 24 can be pivotable with respect to the upper cowl portion 24 about a hinge and/or fully removable from the upper cowl portion 24 via latching connections. As such, the upper cowl portion 24 is moveable into and between a closed position, shown in FIG. 1, in which components of the outboard motor 10 are enclosed by the upper and lower cowl portions 24, 26 and thus inaccessible from above the lower cowl portion 26 and an open position in which the components are accessible from above the lower cowl portion 26.

As is conventional and thus not shown in detail, the outboard motor 10 has an engine 28 that causes rotation of a generally vertically extending driveshaft 29. The type of engine 28 can vary, and for example can be an internal combustion engine or electric motor and/or any other mechanism for causing rotation of the driveshaft. The driveshaft extends into a lower gear case housing 32 and is operatively connected to a transmission gear set 31. The transmission gear set 31 is configured to transfer rotation of the driveshaft to a generally horizontally extending propulsor shaft 34, which causes commensurate rotation of one or more propulsors (not shown). The type of propulsor can vary and for example can be a propeller, impeller, and/or any other mechanism for propelling the marine vessel in water.

Figure 2:
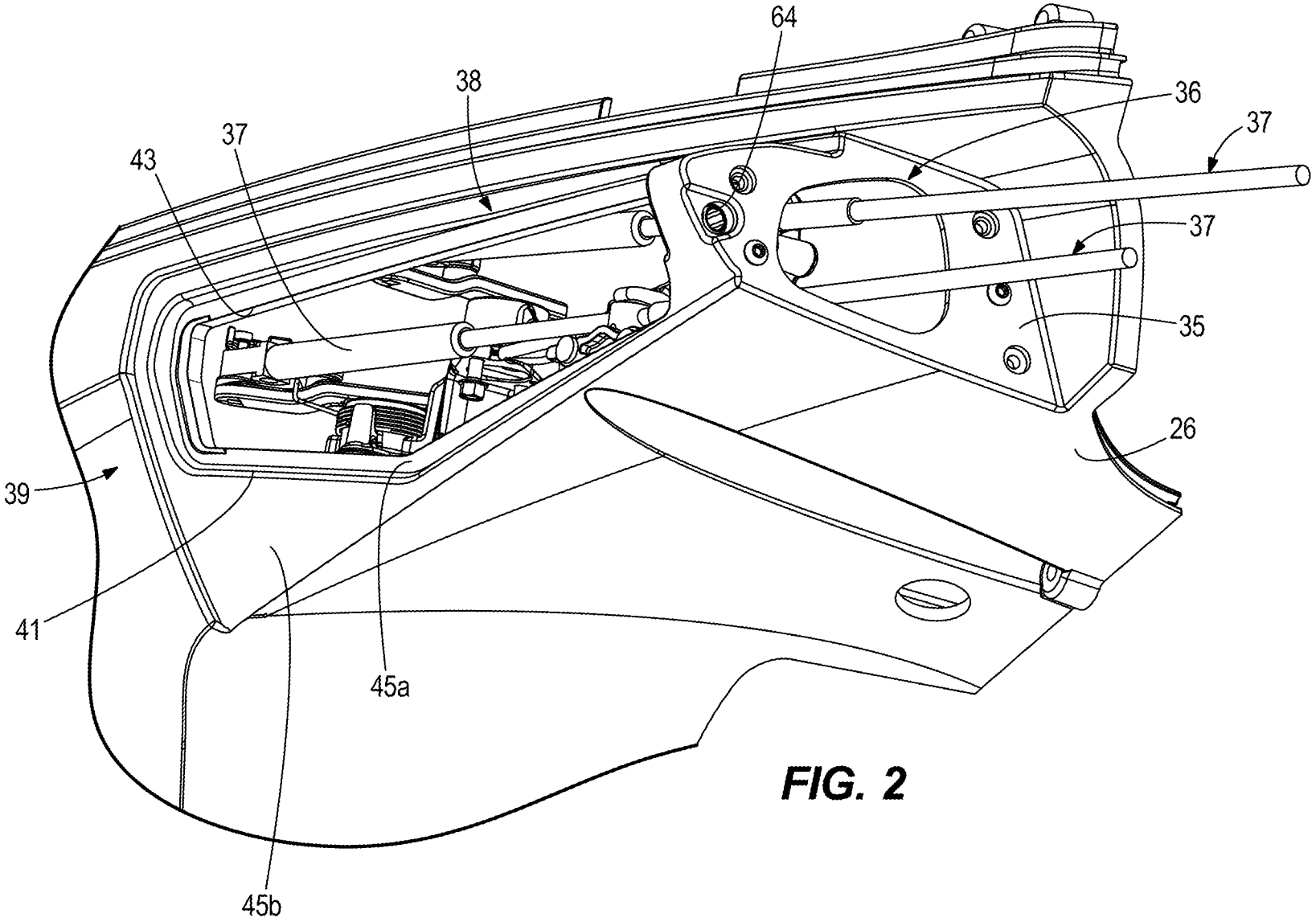
FIG. 2 is a perspective view looking up at a lower cowl portion of the outboard motor, showing a rigging opening that provides access to rigging connectors for rigging the outboard motor to a component on the marine vessel.

As shown in FIG. 2, a rigging port 36 is formed through a generally forwardly facing surface 35 of the lower cowl portion 26. The rigging port 36 is oriented towards (faces) the forward side 20 of the outboard motor 10. The rigging port 36 provides an axial passageway through the lower cowl portion 26 for rigging connectors 37 that extend forwardly from the engine 28 to a component located remotely from the engine 28, for example on the marine vessel to which the outboard motor 10 is connected. The rigging port 36 is generally oval-shaped, however the shape can vary. The rigging connectors 37 can include, but are not limited to conventional electrical lines and/or hydraulic lines and/or push or pull cables and/or fuel lines and/or any other conduit or link and/or any combination of these for operationally connecting the marine vessel and the outboard motor. Returning to FIG. 3, an ingress adapter 44 is connected to the rigging port 36 and supports the rigging connectors 37 with respect to the rigging port 36. In the illustrated example, the ingress adapter 44 is a grommet that is fastened to the forwardly facing surface 35 by (not shown) fasteners.

During research and development, the present inventors have realized that it is desirable to provide access to rigging components on a marine drive, especially in situations where minimal clearance exists between the powerhead and interior cowling surfaces. Prior art marine drives often provide a marginal amount of space to manually complete rigging connections. Further, the present inventors have determined that it is desirable to provide access to the rigging components in a way that maintains water resistivity of the cowling and in a way that is aesthetically pleasing, e.g., avoids the use of unsightly connectors or other attachment mechanisms.

According to the present disclosure, a rigging opening 38 is formed in a laterally facing surface 39 of the lower cowl portion 26. The laterally facing surface 39 is located adjacent to and aftwardly of the rigging port 36. The laterally facing surface 39 is transversely oriented with respect to the forwardly facing surface 35 and generally extends along the starboard side 18 of the outboard motor 10. The rigging opening 38 is sized large enough to provide manual access to the engine 28 and to the rigging connectors 37 from alongside of the outboard motor 10, including when the upper cowl portion 24 is in the closed position shown in FIG. 1. The rigging opening 38 is elongated with respect to the axial direction A and is generally transverse to the rigging port 36 so that the rigging connectors 37 extending through the rigging port 36 run axially parallel to and alongside the rigging opening 38, thus facilitating manual access thereto. The rigging opening 38 has an outer perimeteral edge 41, an inner perimeteral edge 43, and inner and outer sunken base surfaces 45*a*, 45*b* that are sunken below the surface 39 of the lower cowl portion 26. The inner sunken base surface 45*a* is further sunken with respect to the outer sunken base surface 45*b*.

Figure 3:
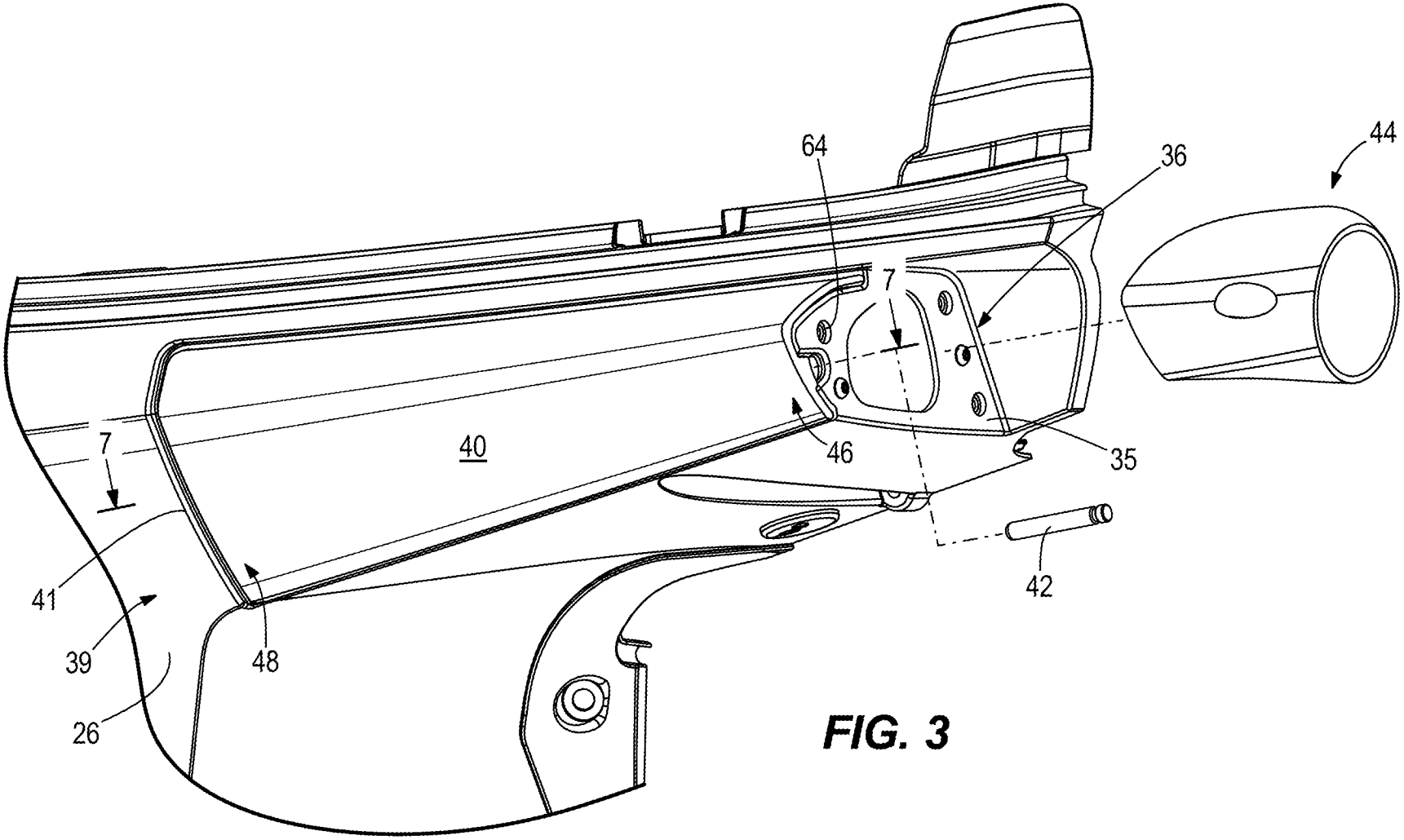
FIG. 3 is an exploded view of the lower cowl portion of the outboard motor, showing a removable access door installed on the rigging opening and an ingress adapter for supporting the rigging connectors with respect to a rigging port on the lower cowl portion.
Figure 4:
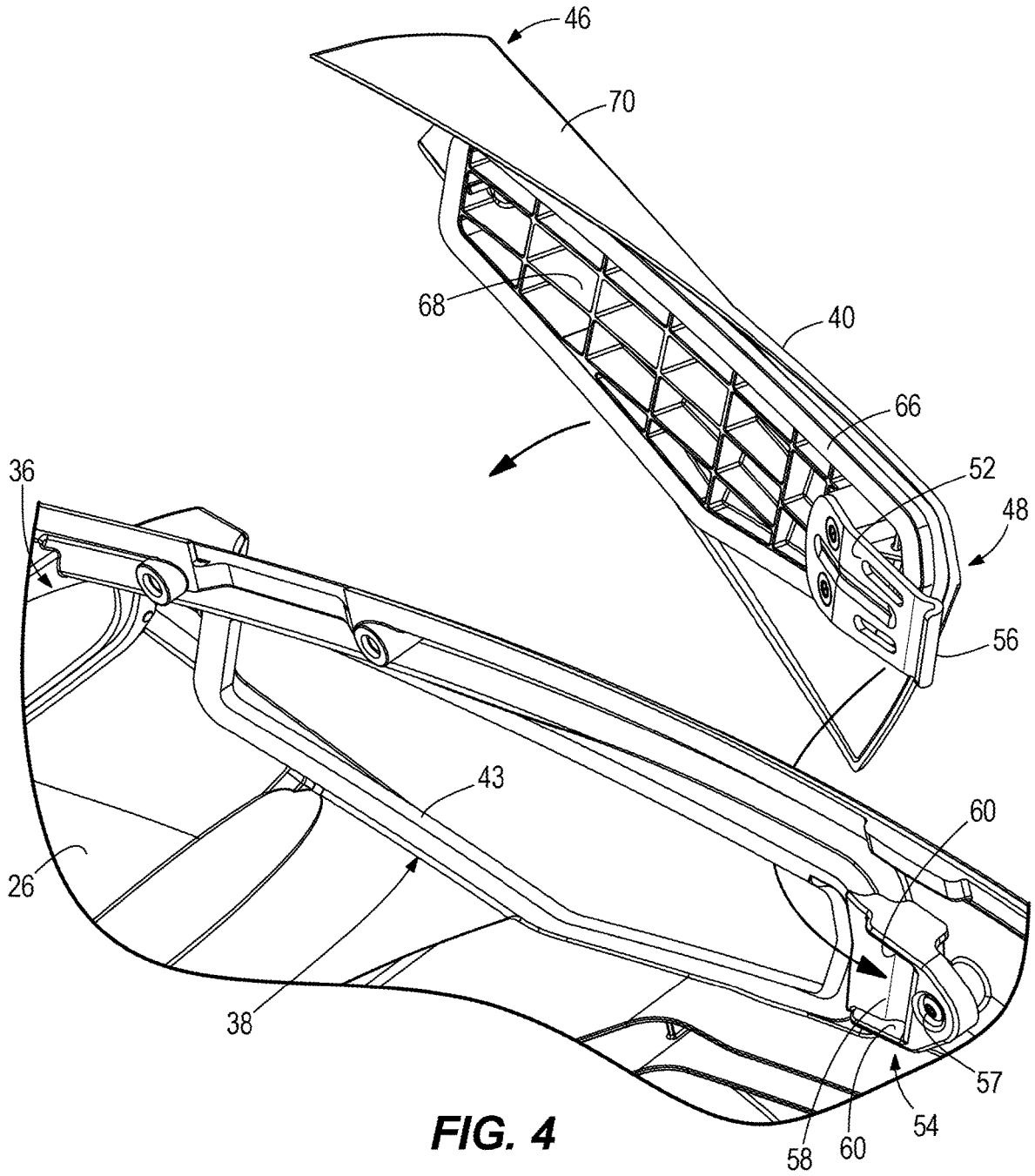
FIG. 4 is an exploded view looking down at the interior of the lower cowl portion, showing the removable access door uninstalled from the rigging opening.
Figure 5:
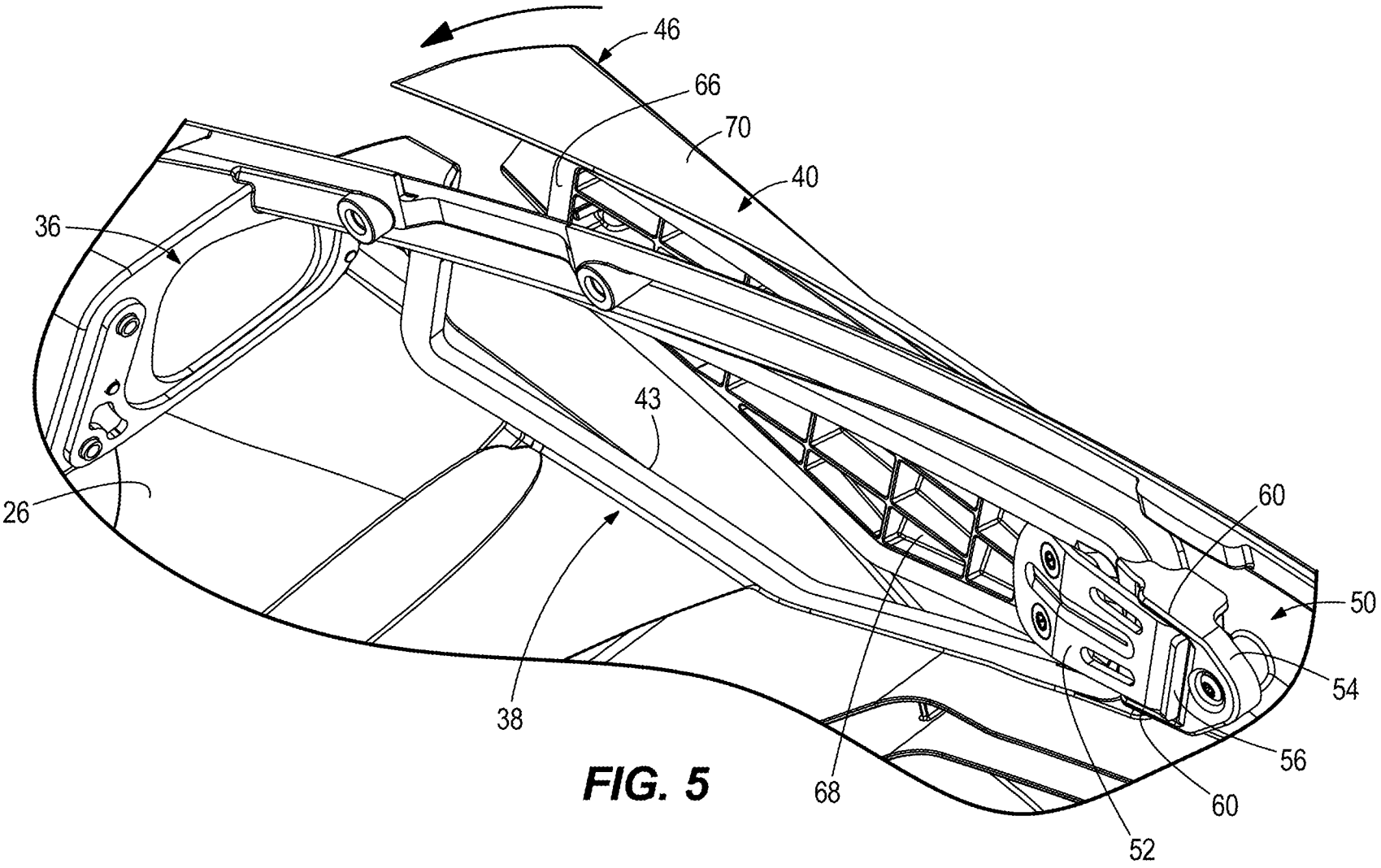
FIG. 5 is a view looking down at the interior of the lower cowl portion, showing the removable access door as it is installed on the rigging opening.
Figure 6:
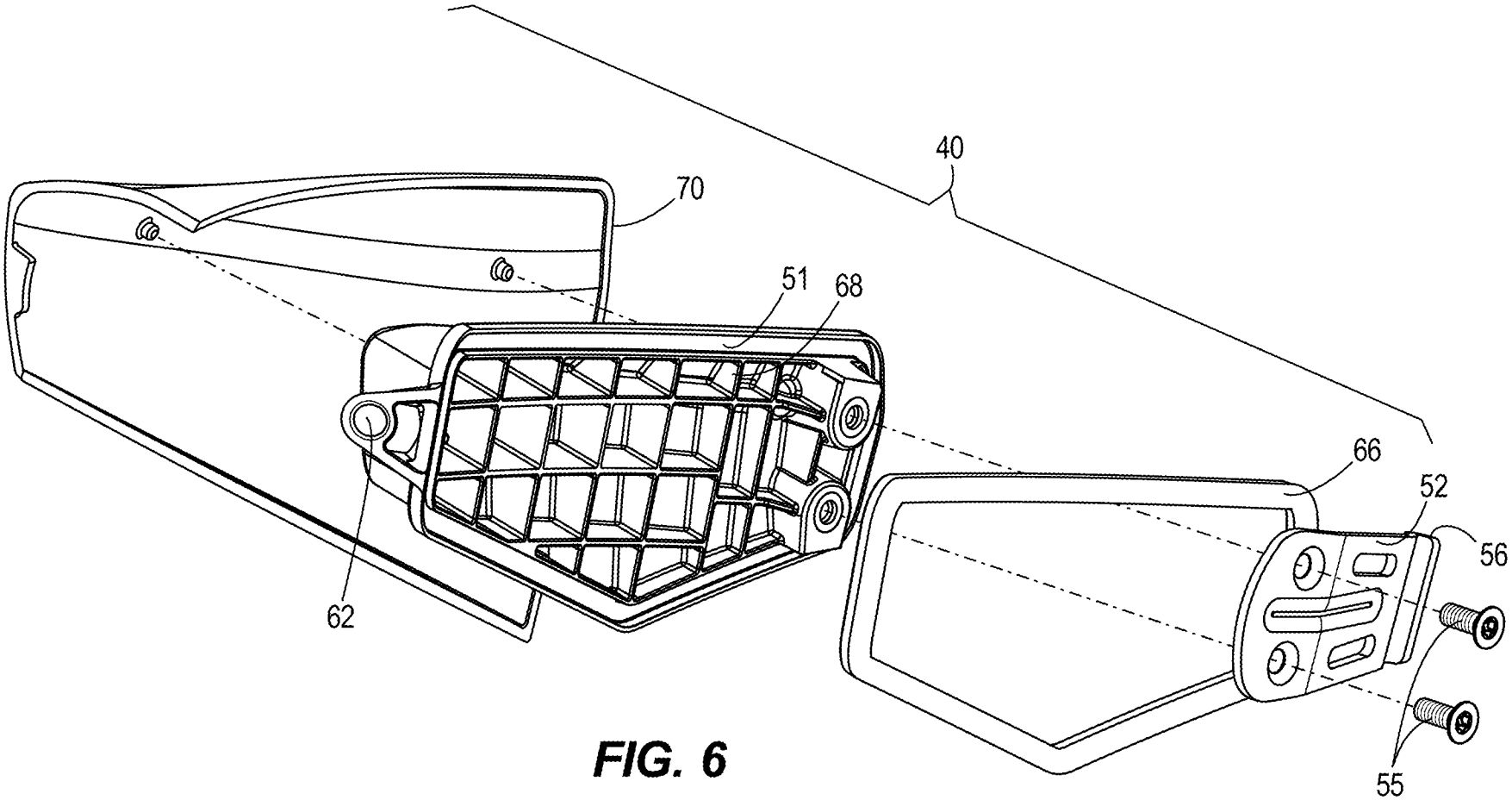
FIG. 6 is an exploded view of the removable access door.
Figure 7:
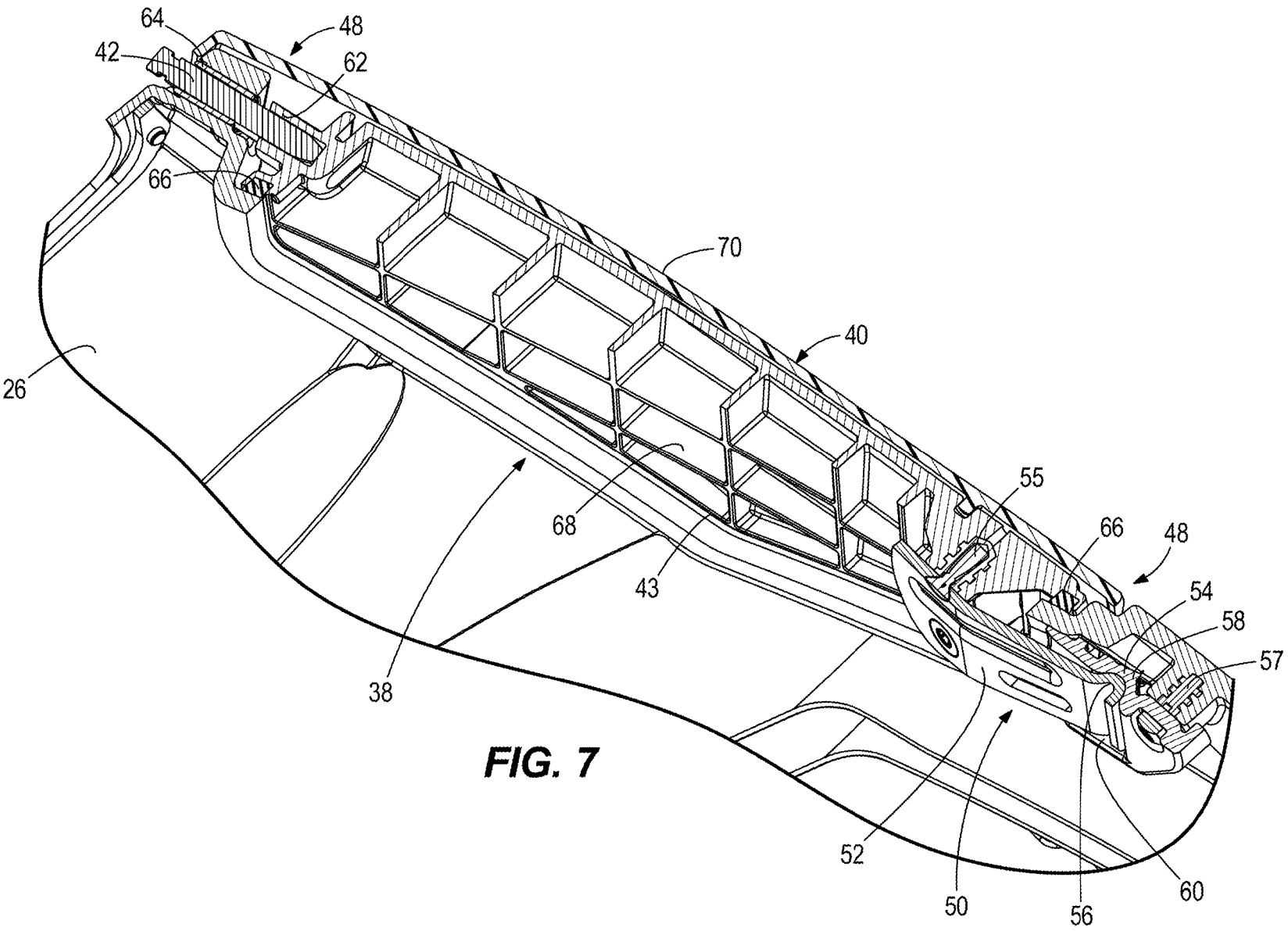
FIG. 7 is a view of section 7-7, taken in FIG. 3.

Referring to FIGS. 3-5, a removable access door 40 covers the rigging opening 38 and prevents manual access to the engine 28 and rigging connectors 37 via the rigging opening 38. The removable access door 40 is elongated in the axial direction A and has a forward end 46 and a rearward end 48. Referring to FIGS. 6 and 7, the removable access door 40 includes an inner plastic frame 68 having stiffening ribs and an outer cosmetic cover 70 that is adhered to the inner plastic frame 68. In non-limiting examples, the removable access door 40 can be made from a sheet molding compound such as polyester resin with glass fibers and calcium carbonate, which is glued to a plastic injection molded piece, such as glass-filled nylon, with stiffening ribs. The removable access door 40 preferably has a thickness that corresponds to the depth of the sunken base surfaces 45*a*, 45*b* with respect to the surrounding outer surface 39, so that when the removable access door 40 is installed over the rigging opening 38, it engages and is supported on the sunken base surfaces 45*a*, 45*b* and lies flush with the surface 39, as shown in FIG. 3. More specifically, the interior surface 51 of the inner plastic frame 68 faces the inner sunken base surface 45*a*, and the inner surfaces of the outer cosmetic cover 70 abut the outer sunken base surface 45*b*, so that the outer cosmetic cover 70 lies flush with the laterally facing surface 39 of the lower cowl portion 26.

Referring to FIGS. 4-7, a gasket seal 66 is disposed on the interior surface 51 (FIG. 6) of the inner plastic frame 68. The gasket seal 66 provides a water-tight seal around the rigging opening 38 between the removable access door 40 and the lower cowl portion 26. The gasket seal 66 is a resilient member, for example made of rubber, which pushes laterally outwardly against the removable access door 40 with respect to the inner sunken base surface 45*a* when the removable access door 40 is installed on the rigging opening 38, thus stabilizing the removable access door 40 with respect to the rigging opening 38.

Referring to FIGS. 5 and 7, a fulcrum device 50 connects the rearward end 48 of the removable access door 40 to the lower cowl portion 26. The fulcrum device 50 includes a fulcrum arm 52 extending from the removable access door 40 and a fulcrum base 54 positioned on the lower cowl portion 26 in the cowl interior. The fulcrum arm 52 is attached to the rearward end 48 of the removable access door by fasteners 55. The fulcrum arm 52 is an axially elongated member having a laterally (outwardly) projecting bend or detent member 56. The fulcrum base 54 has a raised saddle 58 that is attached to the interior of the lower cowl portion 26 by a fastener 57. The raised saddle 58 is engaged by the detent member 56 when the removable access door 40 is installed on the rigging opening 38. Raised edges 60 extend from opposite sides of the raised saddle 58 and define a track there between for axially guiding the detent member 56 over the raised saddle 58 as the removable access door 40 is installed on the rigging opening 38.

Referring to FIGS. 4-5, as the removable access door 40 is installed on the lower cowl portion 26, the fulcrum arm 52 is inserted into the rigging opening 38 and the removable access door 40 is slid axially rearwardly until the fulcrum arm 52 is caused to slide over/across the raised saddle 58, as guided by the raised edges 60. Next, the removable access door 40 is laterally pivoted towards the rigging opening 38 such that the fulcrum arm 52 and raised saddle 58 together provide a fulcrum. As the removable access door 40 becomes seated in the rigging opening 38, the gasket seal 66 seals against the sunken base surface 45*a* of the rigging opening 38 and an axially extending fastener opening 62 on the removable access door 40 becomes aligned with a corresponding axially extending fastener opening 64 formed in the surface 35 and through the lower cowl portion 26 adjacent the rigging opening 38. Thereafter, the removable fastener 42 is inserted through the respective fastener openings 62, 64 to thereby secure the removable access door 40 in place.

Referring to FIGS. 3 and 7, the removable fastener 42 is covered by the ingress adapter 44. The ingress adapter 44 is fastened to the rigging port 36 alongside of and forward of the removable access door 40 in the axial direction A. As shown in FIG. 7, the removable fastener 42 axially extends through the lower cowl portion 26 and into the removable access door 40 to thereby secure the removable access door 40 in place. Thus the removable access door 40 is fastened to the lower cowl portion 26 by a removable fastener 42 that is advantageously hidden from view when the outboard motor 10 is in use, providing an aesthetically pleasing arrangement that protects the interior components of the outboard motor 10 from deleterious effects of the harsh marine environments, while advantageously facilitating easy manual access to the engine 28 and rigging connectors 37 during set up and maintenance.

In the present description, certain terms have been used for brevity, clearness and understanding. No unnecessary limitations are to be implied therefrom beyond the requirement of the prior art because such terms are used for descriptive purposes only and are intended to be broadly construed. The different systems, methods and apparatuses described herein may be used alone or in combination with other systems, methods and apparatuses. Various equivalents, alternatives and modifications are possible within the scope of the appended claims.

What is claimed is:

1. A marine drive comprising:

an engine;

a cowl having first and second cowl portions, wherein the first cowl portion is movable with respect to the second cowl portion into an open position in which the engine is manually accessible and a closed position in which the engine is enclosed by the cowl;

a rigging port in the second cowl portion, the rigging port providing a passageway for rigging connectors that extend from the engine to a component located remotely from the engine;

a rigging opening in the second cowl portion, the rigging opening providing manual access to the rigging connectors and the engine, including when the first cowl portion is in the closed position; and a removable access door covering the rigging opening and preventing manual access to the engine and rigging connectors via the rigging opening.

2. The marine drive according to claim 1, wherein the removable access door is fastened to the second cowl portion by a removable fastener, wherein the removable fastener is covered by an ingress adapter for the rigging connectors, the ingress adapter being disposed on the rigging port and supporting the rigging connectors with respect to the rigging port.

3. The marine drive according to claim 1, wherein the removable access door is fastened to the second cowl portion by a removable fastener, and wherein the removable fastener extends through the second cowl portion and into the removable access door.

4. The marine drive according to claim 1, wherein the removable access door is fastened to the second cowl portion by a removable fastener, and wherein the removable access door has a first end to which the removable fastener is connected and an opposite, second end that is coupled to the second cowl portion by a fulcrum device.

5. The marine drive according to claim 4, wherein the fulcrum device comprises a fulcrum arm on the removable access door and a fulcrum base on the second cowl portion.

6. The marine drive according to claim 5, wherein the fulcrum arm comprises a detent member and the fulcrum base comprises a raised saddle that is engaged by the detent member when the removable access door is installed on the rigging opening.

7. The marine drive according to claim 6, further comprises raised edges on opposite sides of the raised saddle, the raised edges providing a track that guides the detent member over the raised saddle as the removable access door is installed on the rigging opening.

8. The marine drive according to claim 7, wherein as the removable access door is installed onto the second cowl portion, the detent member slides over the raised saddle so that the removable access door is pivotable towards the rigging opening about the fulcrum device until a fastener opening on the removable access door becomes aligned with a fastener opening on the second cowl portion such that the removable fastener is insertable through the fastener openings to thereby secure the removable access door in place.

9. The marine drive according to claim 1, further comprising a gasket seal on the removable access door, the gasket seal providing a peripheral seal around the rigging opening between the removable access door and the second cowl portion.

10. The marine drive according to claim 9, wherein the gasket seal is a resilient member that pushes outwardly against the removable access door with respect to the rigging opening when the removable access door is installed on the rigging opening, thus stabilizing the removable access door with respect to the rigging opening.

11. The marine drive according to claim 1, wherein the removable access door comprises a plastic frame with stiffening ribs and an outer cosmetic cover that is adhered to the plastic frame.

12. An outboard motor that extends from top to bottom in a vertical direction, from port side to starboard side in a lateral direction that is perpendicular to the vertical direction, and from forward side to afterward side in an axial direction that is perpendicular to the vertical direction and perpendicular to the lateral direction, the outboard motor comprising:

an engine;

an upper cowl portion and a lower cowl portion, wherein the upper cowl portion is movable with respect to the lower cowl portion into an open position in which the engine is manually accessible from above the lower cowl portion, and a closed position in which the engine is enclosed by the cowl;

a rigging port in the lower cowl portion, the rigging port being oriented towards the forward side of the outboard motor and providing a passageway for rigging connectors that extend from the engine to a component located forwardly of the engine;

a rigging opening in the lower cowl portion, the rigging opening providing manual access to the engine and rigging connectors from alongside the outboard motor, including when the upper cowl portion is in the closed position; and a removable access door covering the rigging opening and preventing manual access to the engine and rigging connectors via the rigging opening, wherein the removable access door is fastened to the lower cowl portion by a removable fastener.

13. The outboard motor according to claim 12, wherein the removable fastener is covered by an ingress adapter that supports the rigging connectors with respect to the rigging port, the ingress adapter being located on the rigging port alongside and forwardly of the removable access door in the axial direction.

14. The outboard motor according to claim 13, wherein the removable fastener axially extends through the lower cowl portion and into the removable access door.

15. The outboard motor according to claim 14, wherein the removable access door is elongated in the axial direction and has a forward end to which the removable fastener is connected and a rearward end that is connected to the lower cowl portion by a fulcrum device that comprises a fulcrum arm on the removable access door and a fulcrum base on the other of the removable access door and the lower cowl portion.

16. The outboard motor according to claim 15, wherein the fulcrum arm has a detent member and the fulcrum base has a raised saddle that is engaged by the detent member when the removable access door is installed on the rigging opening.

17. The outboard motor according to claim 16, further comprising raised edges on opposite sides of the raised saddle, the raised edges extending in the axial direction and providing a track for axially guiding the detent member as the removable access door is installed on the rigging opening.

18. The outboard motor according to claim 17, wherein as the removable access door is installed onto the second cowl portion, the detent member axially slides over the raised saddle so that the removable access door is pivotable towards the rigging opening about the fulcrum device until a fastener opening on the removable access door becomes aligned with a fastener opening on the second cowl portion such that the removable fastener is insertable through the fastener openings to thereby secure the removable access door in place.

19. The outboard motor according to claim 18, further comprising a gasket seal on the removable access door, the gasket seal providing a seal around the rigging opening between the removable access door and the lower cowl portion, wherein the gasket seal is a resilient member that pushes outwardly against the removable access door with respect to the rigging opening when the removable access door is installed on the rigging opening, thus stabilizing the removable access door with respect to the rigging opening.

20. The outboard motor according to claim 12, wherein the removable access door comprises a plastic frame having stiffening ribs and further comprises an outer cosmetic cover that is adhered to the plastic frame.

* * * * *